United States Patent [19]

Jelonek et al.

[11] 4,381,830

[45] May 3, 1983

[54] CONTINUOUS FLOW EARMOLD TUBING CONNECTOR

[76] Inventors: Chester J. Jelonek, Richmond; Norman Schlagel, Fremont, both of Calif.

[21] Appl. No.: 287,237

[22] Filed: Jul. 27, 1981

[51] Int. Cl.[3] ..... H04R 25/00

[52] U.S. Cl. ..... 181/129; 181/130; 179/107 H

[58] Field of Search ..... 181/22, 129–135; 179/107 H; 128/152

[56] References Cited

U.S. PATENT DOCUMENTS

| | | | |
|---|---|---|---|
| 3,431,370 | 3/1969 | Crosby | 181/130 X |
| 3,813,499 | 5/1974 | Virgnini | 179/107 H |
| 4,311,206 | 1/1982 | Johnson | 181/135 |

FOREIGN PATENT DOCUMENTS

| | | | |
|---|---|---|---|
| 473524 | 7/1969 | Switzerland | 179/107 H |

*Primary Examiner*—Benjamin R. Fuller

[57] ABSTRACT

A connector connects sound conduction tubing from a hearing aid to a sound conduction bore in an earmold. The connector is an elbow-shaped member with one end receiving an end of the sound conduction tubing while the other end has latching means that latchably mate with an entry section of the sound conduction bore. The inside diameter of the sound conduction tubing, the diameter of a sound conduction tubular passage in the elbow-shaped member and the diameter of the sound conduction bore are the same therealong thereby defining a continuous flow sound conduction path from the hearing aid to the end of a canal of the earmold.

9 Claims, 4 Drawing Figures

Fig-1
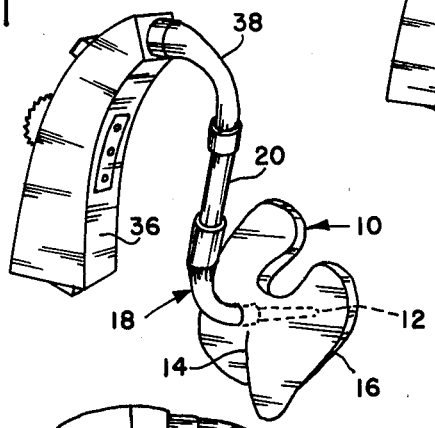
Fig-2
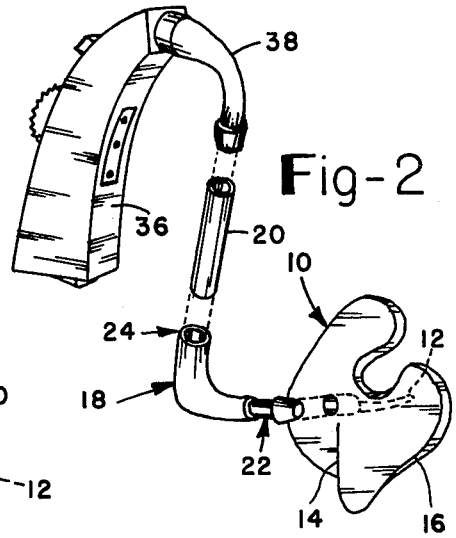
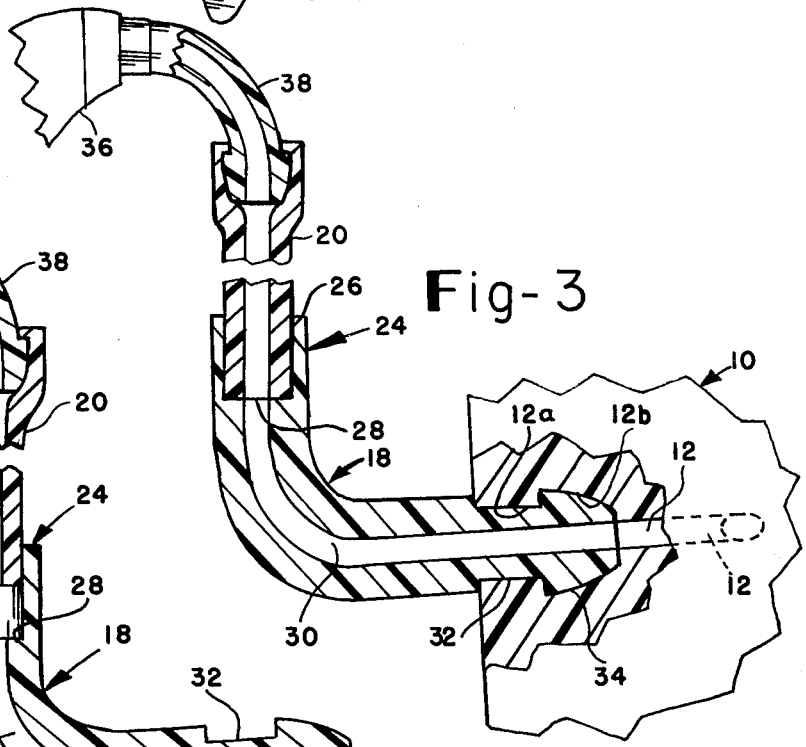
Fig-3
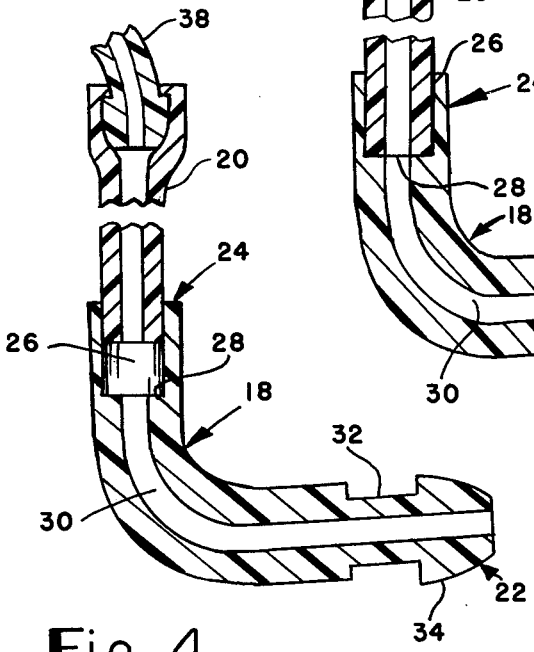
Fig-4

CONTINUOUS FLOW EARMOLD TUBING CONNECTOR

BACKGROUND OF THE INVENTION

Earmolds of soft plastic material are known and used to connect tubing from the ear hook of behind the ear hearing aids and the sound conduction member of spectacle-type hearing aids. The earmolds fit in the ears of hearing-impaired persons and they include sound conduction openings in which an end of the tubing is located. The tubing-receiving section of the sound conduction opening in which the end of the tubing is to be frictionally secured has a larger diameter than the remaining section of the sound conduction opening to accommodate the tubing so that the inside diameter of the tubing is the same as the diameter of the remaining section of the sound conduction opening.

As a result of the use of friction to secure the tubing end in the tubing-receiving section of the sound conduction opening, the inside diameter of the tubing is reduced thereby creating discontinuities in the sound conduction path between the hearing aid and the eardrum which changes the response of the hearing aid.

Connectors have been used to connect the tubing to the ear mold and these are right-angled tubular members with one leg frictionally secured in the tubing-receiving section of the sound-conduction opening and the tubing fits onto the other leg of the connector. This creates a discontinuity and also changes the response of the hearing aid.

SUMMARY OF THE INVENTION

The present invention relates to connectors and more particularly to connectors for connecting sound conduction tubing to a sound conduction opening in an earmold.

The present invention is realized by an elbow-shaped connector that is molded from plastic material. It has about an 80 degree bend and includes a sound conduction tubular passage therealong having the same diameter along its length. One leg of the connector defines a tubing-receiving section for receiving an end of the sound conduction tubing therein; the internal diameter of the tubing-receiving section being only slightly greater than the outside diameter of the sound conduction tubing to enable the tubing to be easily fitted into the tubing-receiving section and the internal diameter of the sound conduction tubing is the same as the diameter of the sound conduction tubular passage in the connector. The other leg of the connector is provided with a nubbin having a conically-shaped barb at its outer end and a surface adjacent the barb of reduced diameter. The other leg is inserted in a section of a sound conduction bore of an earmold which has a configuration conforming to that of the conically-shaped barb and surface of reduced diameter thereby latching the connector in position in the sound conduction bore of the earmold with the remaining section of the sound conduction bore having the same diameter as that of the sound conduction tubular passage and the sound conduction tubing.

An object of the present invention is to provide a connector for connecting sound conduction tubing from a hearing aid to a sound conduction opening of an earmold.

Another object of the present invention is the provision of a connector for connecting sound conduction tubing from a hearing aid to a sound conduction opening of an earmold so that the diameter of the sound conduction path along the sound conduction tubing, the sound conduction passage in the connector and the sound conduction opening is the same therealong.

A further object of the present invention is to provide a section of an earmold connector to receive an end of a sound conduction tubing therein so that the internal diameter of the sound conduction tubing is the same as a sound conduction passage in the connector.

An additional object of the present invention is the provision of an earmold connector having latch means to latchingly secure the connector within a sound conduction opening of an earmold.

Still another object of the present invention is to provide a chamber in an earmold connector between the end of the sound conduction tubing and the tubing-receiving section of the connector to form a resonating chamber to better process sound of higher frequency.

The foregoing and other objects and advantages of the invention will more fully appear from the following description when taken in connection with the accompanying drawing. It is to be understood that variations of the present invention can be made without departing from the scope of the invention as disclosed herein.

BRIEF DESCRIPTION OF THE DRAWING

FIG. 1 is a perspective and exploded view of an earmold, earmold tubing connector, sound conduction tubing and hearing aid;

FIG. 2 is a view similar to FIG. 1 with the parts assembled together;

FIG. 3 is a cross-sectional view of the earmold, earmold tubing connector and sound conduction tubing; and FIG. 4 is a cross-sectional view of an alternative embodiment.

DETAILED DESCRIPTION OF THE INVENTION

A conventional earmold 10 is molded from a plastic material to conform to and frictionally fit within a person's ear. The earmold is a pliable plastic that is compressible when finger and thumb pressure is applied thereto which classifies it as a soft plastic material. The earmold can also be made of a hard plastic material such as Lucite plastic.

The earmold includes a sound conduction opening or sound bore 12 extending from the bridge 14 and through the canal 16 which extends into the ear canal. The outer part of sound conduction bore 12 has a nubbin-receiving section defining section **12*a* having a diameter larger than bore 12 and a section 12*b* in the form of a frustum of a cone; bore 12 has the same diameter therealong from section 12*b* to the end of canal 16**.

A connector 18 is molded from a suibable plastic material such as clear vinyl. It is elbow-shaped and has a bend of 80 degrees instead of 90 degrees for a better fit into sections **12*a* and 12*b* of bore 12, retention of the connector therein and orientation to receive one end of sound conduction tubing 20 therein which is also made of clear vinyl plastic like connector 18**.

Connector 18 has a nubbin 22 at one end and a tubing receiving section 24 at the other end. Tubing receiving section 24 has a bore 26 that has a diameter only slightly larger than the outside diameter of sound conduction tubing 20 so that tubing 20 can be readily fitted within bore 26 against shoulder 28 with a conventional vinyl glue being used to secure tubing 20 within connector 18.

A sound conduction tubular passage 30 extends through connector 18 from bore 26 to the outer end of nubbin 22 and its diameter is the same as the inside diameter of sound conduction tubing 20 thereby defining a sound conduction path having the same diameter therealong.

Nubbin 22 has a conically-shaped surface of reduced diameter 32 and a conically-shaped barb 32 which mate with and conform to sections 12*a* and 12*b* respectively of sound conduction bore 12 in earmold 10 when nubbin 22 is force fitted into the nubbin-receiving section of bore 12. This can be done because connector 12 is flexible and nubbin 22 can be fitted into the nubbin receiving section.

When nubbin 22 is fitted into the nubbin-receiving section of bore 12 so that reduced-diameter surface 32 fits with section 12*a* and conically-shaped barb 32 fits within section 12*b*, a sealed connection is made and nubbin 22 is latchably secured with the nubbin-receiving section of bore 12 to connect sound conduction tubing 20 to the sound conduction bore 20 of earmold 10. This arrangement enables connector 18 to be easily unlatched from the earmold to enable tubing 20, connector 18 and bore 12 to be cleaned.

The diameter of bore 12 from section 12*b* to the outer end of canal 16 is the same as sound conduction tubular passage 30. Thus, when tubing 20 is secured within bore 26 and nubbin 22 is latchably connected within sections 12*a* and 12*b* of bore 12, a sound conduction path of the same diameter extends therealong which does not change the acoustical characteristics of amplified sound emanating from hearing aid 36 which has its ear hook 38 connected onto sound conduction tubing 20. Hearing aid 36 can be a behind the ear or spectacles hearing aid. The sound conduction passageway in the ear hook 38 and in the spectacles hearing aid has a diameter the same as the internal diameter of the sound conduction tubing. In this way, the fidelity of the frequencies of sound signals amplified by the hearing aid are more true because the sound conduction path along the sound conduction passageway, the sound conduction tubing, the sound conduction tubular passage and the sound conduction bore has the same diameter therealong.

FIG. 4 illustrates an embodiment of the present invention wherein the end of sound conduction tubing 20 is spaced from shoulder 28 within bore 26. This forms a chamber between the end of tubing 20 and sound conduction tubular passage 30. This chamber defines a resonating chamber to increase the processing of high frequency signals.

The present invention enables easy latchable connection of tubing from the hearing aid to the earmold and disconnection therefrom, provides a sound conduction path from the hearing aid to the end of the canal having the same diameter therealong and can form a resonating chamber in the connection of the tubing to the connector to increase high frequency signals.

Although the invention has been described as hereinbefore set forth, it will be appreciated that various changes and modifications may be made therein without departing from the scope of the invention as claimed in the accompanying claims.

The invention is claimed in accordance with the following:

1. A connector for connecting sound conduction tubing from a hearing aid to a sound conduction bore of an earmold, comprising:

an elbow-shaped member having a tubing-receiving section and a nubbin section;

said member having a sound conduction tubular passage extending from said tubing-receiving section to the outer end of said nubbin section;

said tubing-receiving section having a bore larger in diameter than said sound conduction tubular passage and slightly larger than the external diameter of the sound conduction tubing so that an end of the sound conduction tubing can be fitted therein, and, when the sound conduction tubing end is fitted within said tubing-receiving section, the internal diameter of the sound conduction tubing is the same as that of said sound conduction tubular passage; and said nubbin section defining latching means that is fitted into a section of a sound conduction bore of the earmold that has a complementary configuration as that of said latching means so that said nubbin section is latched within the section of the sound conduction bore and the diameter of the sound conduction bore at the outer end of said nubbin section is the same as that of said sound conduction tubular passage.

2. A connector according to claim 1 wherein said elbow-shaped member has a bend of about 80 degrees.

3. A connector according to claim 1 wherein said latching means includes a surface of reduced diameter and a conically-shaped barb.

4. A connector according to claim 1 wherein said latching means is sealingly latched within the section of the sound conduction bore.

5. A connector for connecting sound conduction tubing from a hearing aid to a sound conduction bore in an earmold, comprising:

an elbow-shaped member having a sound conduction tubular passage extending therethrough;

a tubing-receiving section at one end of said elbow-shaped member having a bore of a diameter larger than said sound conduction tubular passage and slightly larger than the outside diameter of the sound conduction tubing so that an end of the sound conduction tubing can be fitted within said bore; and latching means at the other end of said elbow-shaped member that mates with an entry section of the sound conduction bore for latchably securing said elbow-shaped member within the entry section, wherein the diameter of said sound conduction tubular passage is the same as the internal diameter of the sound conduction tubing and the sound conduction bore at an exit section thereof so that when said elbow-shaped member connects the sound conduction tubing to the sound conduction bore, a continuous flow sound conduction path is formed having the same diameter therealong.

6. A connector according to claim 5 wherein the interface between said sound conduction tubular passageway and said bore defines a shoulder and the end of the sound conduction tubing when fitted within said bore can be spaced from said shoulder thereby defining a resonating chamber to increase high frequency signals.

7. A hearing aid system, comprising:

a hearing aid having sound conduction means;

sound conduction tubing having one end connected onto said sound conduction means;

earmold means having a sound conduction bore extending therethrough, said sound conduction bore having an entry section and exit section and connector means defining an elbow-shaped member including a tubing-receiving section, a latching means and a sound conduction tubular passage extending from said tubing-receiving section to the outer end of said latching means, said tubing receiving section having a diameter to receive another end of said sound conduction tubing therein so that the internal diameter of said sound conduction tubing is the same as the diameter of said sound conduction tubular passage, said latching means mating with said entry section to latchably secure said elbow-shaped member in said earmold so that said sound conduction tubular passage has the same diameter as the exit section of said sound conduction bore.

8. A hearing aid system according to claim 7 wherein the bend of said elbow-shaped member is about 80 degrees.

9. A hearing aid system according to claim 7 wherein said latching means includes a surface of reduced diameter and a conically-shaped barb mating with a complementary-shaped area of said entry section.

* * * * *